US006245164B1

(12) United States Patent
Liu et al.

(10) Patent No.: US 6,245,164 B1
(45) Date of Patent: Jun. 12, 2001

(54) DUAL-PHASE CR-TA ALLOYS FOR STRUCTURAL APPLICATIONS

(75) Inventors: Chain T. Liu; Michael P. Brady, both of Oak Ridge; Jiahong Zhu; Peter F. Tortorelli, both of Knoxville, all of TN (US)

(73) Assignee: U T Battelle, LLC, Oak Ridge, TN (US)

( * ) Notice: Subject to any disclaimer, the term of this patent is extended or adjusted under 35 U.S.C. 154(b) by 0 days.

(21) Appl. No.: 09/277,081

(22) Filed: Mar. 26, 1999

(51) Int. Cl.[7] ..... C22C 27/06
(52) U.S. Cl. ..... 148/423; 420/428
(58) Field of Search ..... 148/423; 420/428

(56) References Cited

U.S. PATENT DOCUMENTS 3,015,559 * 1/1962 McGurthy et al. ..... 75/176
3,138,456 * 6/1964 Edwards ..... 75/176
5,282,907 2/1994 Liu et al. ..... 148/423
5,338,379 8/1994 Kelly ..... 148/410

OTHER PUBLICATIONS

Max Hansen, 1958, Constitution of Binary Alloys, p. 563.*

* cited by examiner

*Primary Examiner*—Roy King
*Assistant Examiner*—Nicole Coy
(74) *Attorney, Agent, or Firm*—J. Herbert O'Toole; Hardaway/Mann IP Group; Nexsen Pruet Jacobs & Pollard, LLC

(57) ABSTRACT

Dual phase alloys of chromium containing 2 to 11 atomic percent tantalum with minor amounts of Mo, Cr, Ti, Y, La, Cr, Si and Ge are disclosed. These alloys contain two phases including Laves phase and Cr-rich solid solution in either eutectic structures or dispersed Laves phase particles in the Cr-rich solid solution matrix. The alloys have superior mechanical properties at high temperature and good oxidation resistance when heated to above 1000° C. in air.

1 Claim, 7 Drawing Sheets

DUAL-PHASE CR-TA ALLOYS FOR STRUCTURAL APPLICATIONS

STATEMENT AS TO RIGHTS TO INVENTIONS MADE UNDER FEDERALLY SPONSORED RESEARCH AND DEVELOPMENT

The U.S. Government has rights in this invention pursuant to contract number DE-AC05-96OR22464 between Lockheed Martin Energy Research Corporation and the Department of Energy.

FIELD OF THE INVENTION

This invention is directed towards alloys for high temperature structural applications having a Cr-rich solid solution and containing a Ta-rich Laves phase primarily in eutectic or hypoeutectic alloy compositions. The alloys can be used in both cast and fabricated conditions.

STATEMENT AS TO RIGHTS TO INVENTIONS MADE UNDER FEDERALLY SPONSORED RESEARCH AND DEVELOPMENT

High temperature energy conversion systems require materials having both high strength and high stability at temperatures which soften or oxidize currently available metals. We previously reported development of a two-phase Cr—Nb alloys which were two-phase systems having mechanical properties superior to Ni-based "superalloys" currently used in very high temperature conditions. We described and disclosed in U.S. Pat. No. 5,282,907 systems having five to eighteen percent Nb, one to ten percent Re and 0.5 to 10% Al and up to about 1 percent of any elements selected from V, Ta, Hf, Zr, and Y. These alloys display excellent strength and creep resistance at temperatures up to 1250° C. under compression tests and acceptable oxidation resistance up to 1,000° C. Unfortunately, the fracture strength is less than 50 ksi in tension at 1,000° C. and surface spalling is observed during cyclic oxidation to 1,000° C. These characteristics impose limitations which may not be acceptable in terms of weight, shock resistance and regular exposure to very high temperatures as would occur, for example, in high performance turbine engines which are routinely stopped and started.

SUMMARY OF THE INVENTION

It is an object of this invention to produce Cr-based alloys having very high strength at temperatures above 1,000° C.

It is another object of this invention to produce alloys which are Cr-based which possess excellent oxidation resistance when cycled repeatedly to temperatures of 1,000° C.

It is an object of this invention to disclose how to make Cr-based alloys having properties of superior strength and oxidation resistance.

It is a further object of this invention to disclose methods for fabricating articles according to the previous objects of this invention.

These and other objects of the invention are achieved by a dual-phase alloy having up to 11 percent Ta, up to 7% Mo and minor amounts of Ti, Si, Ge Ce, La, Y and other rare-earth elements. The objects of this invention are achieved by melting and casting the pure metals into alloy ingots and by subsequent hot fabrication, such as hot extrusion at high temperatures. (The alloys can be used as both cast and fabricated material.)

DETAILED DESCRIPTION OF THE INVENTION

Figure 7:
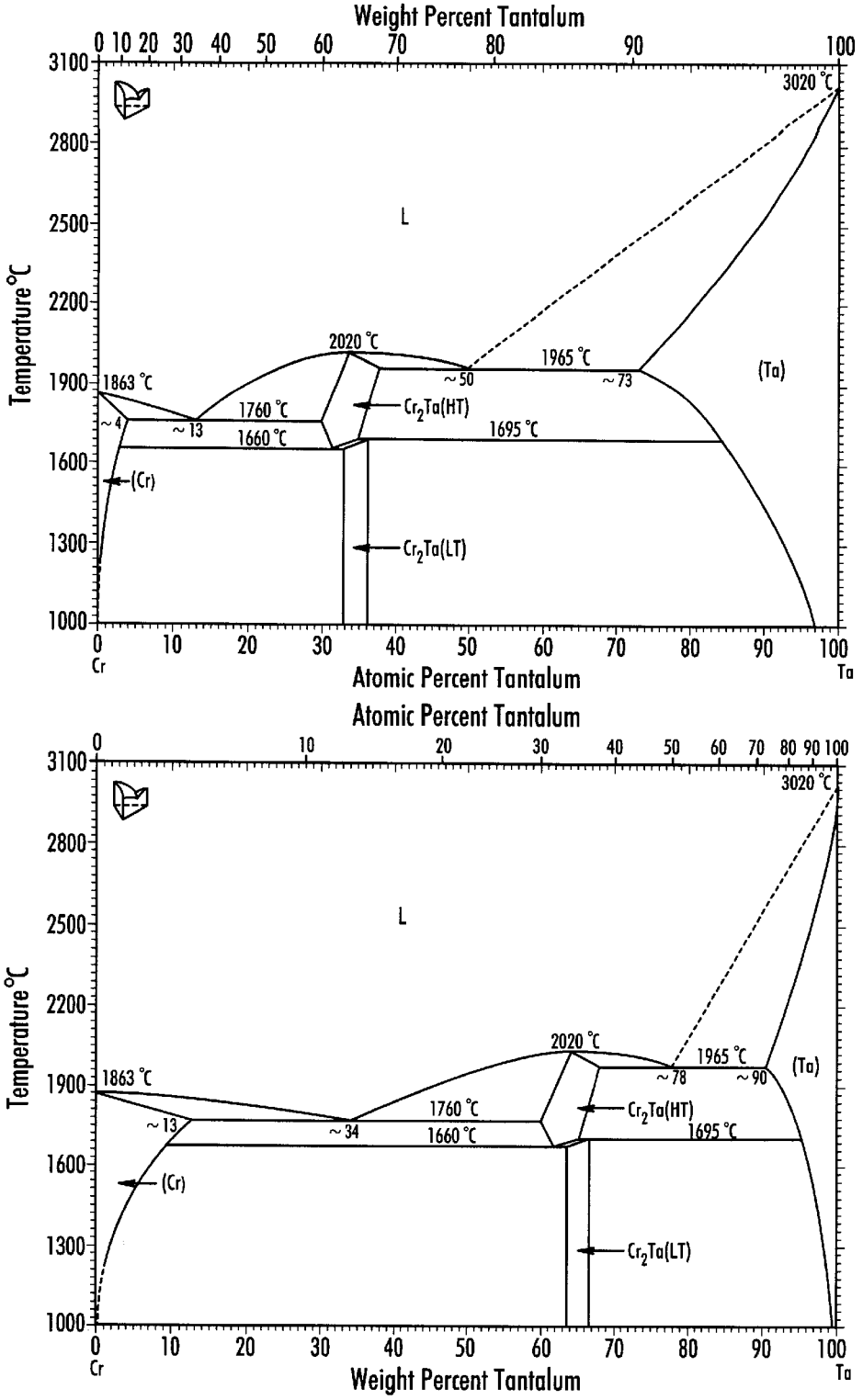
FIG. 7 is a phase diagram for the Cr—Ta system.

The crystal structure of Cr is bcc. Laves phases are alloy phases which have the general formula $AB_2$ and the crystal structures of either $MgCu_2$, which is complex cubic or of $MgZn_2$ or $MgNi_2$, both of which are complex hcp. Tantalum reacts with chromium to form the Laves phase $Cr_2Ta$ which has a melting point of 2020° C. (c.f. FIG. 7). The compound is not well characterized in terms of its mechanical or metallurgical properties but it had been reported that the Laves phase in single-phase form is very brittle at ambient temperatures.

We have discovered that the presence of Ta in amounts not exceeding the eutectic composition (determined to be around 9.8 atomic % Ta) show remarkable hardness. Hypereutectic alloys with >11 atomic % Ta become brittle and rapidly lose their impact resistance with increasing atomic percentage of Ta.

We prepared samples of alloys containing 8 to 13 atomic percent Ta and compared their oxidation resistance to Cr—10Nb, an alloy according to our U.S. Pat. No. 5,282,907 and to pure Cr.

Figure 4:
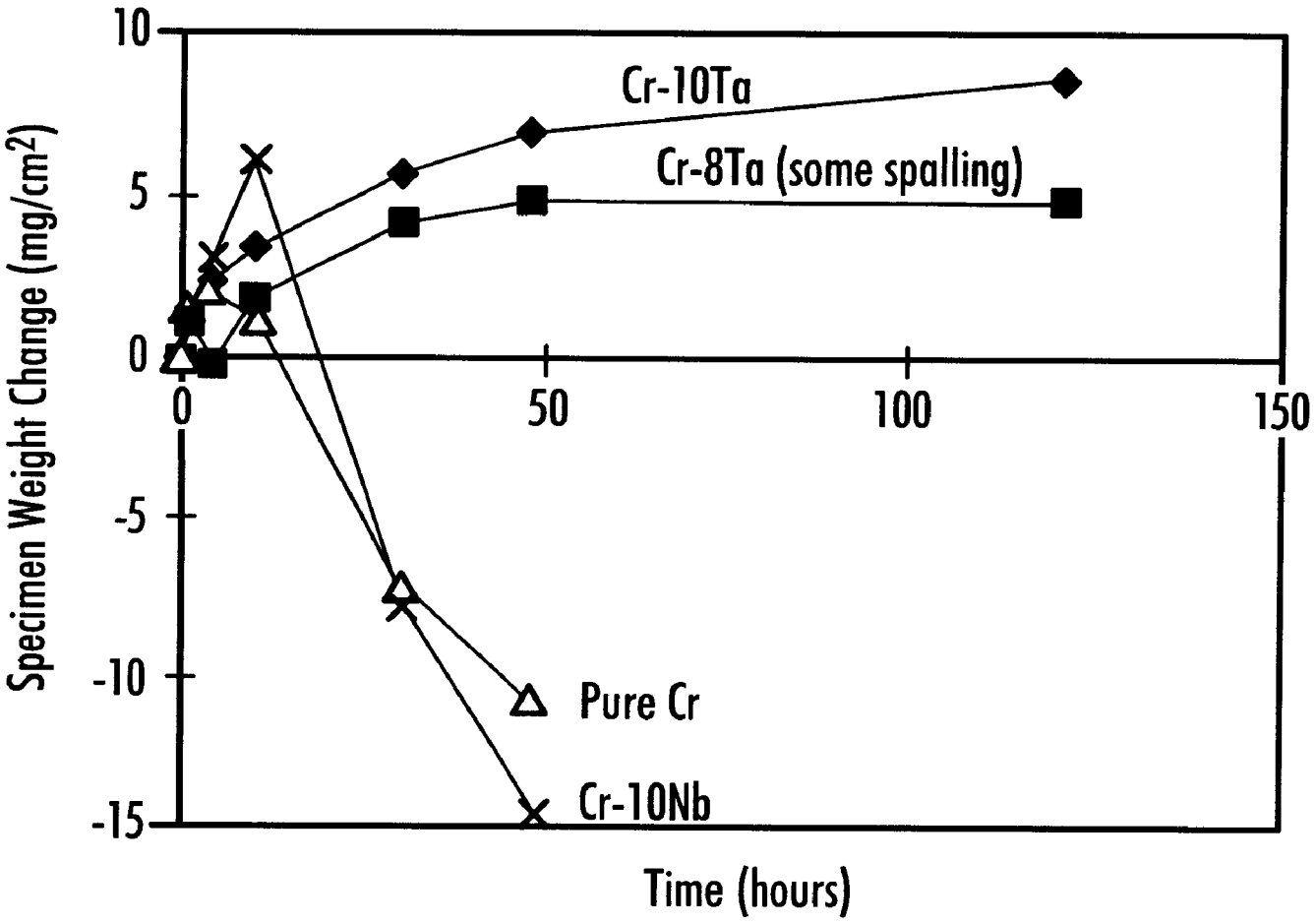
FIG. 4 is a graph of weight vs time for the cyclic oxidation at 1100° C. of selected samples.
Figure 5:
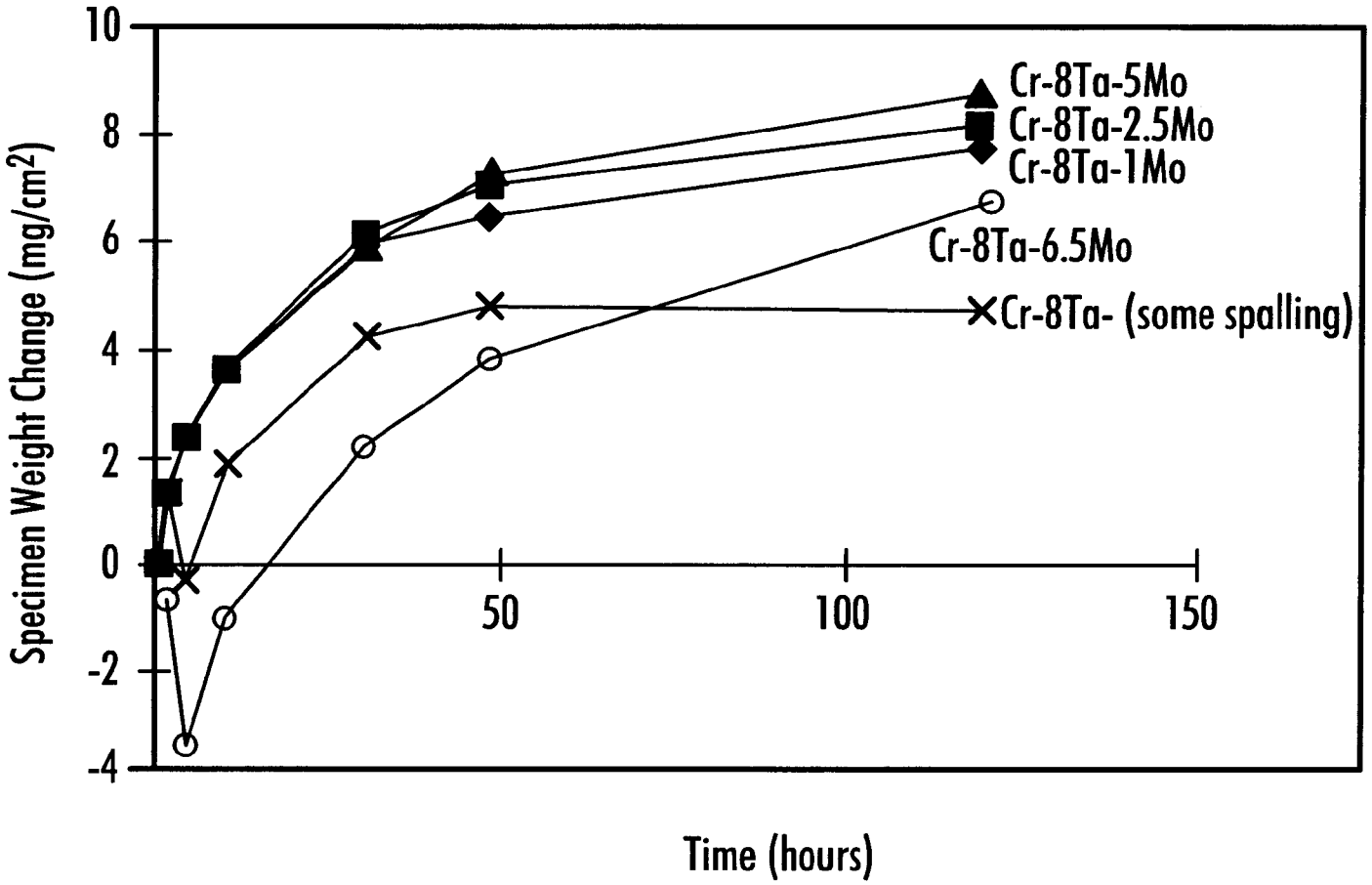
FIG. 5 is a graph of weight vs time for the cyclic oxidation at 1100° C. showing the beneficial effects of Mo addition to Cr—8Ta alloy.
Figure 6:
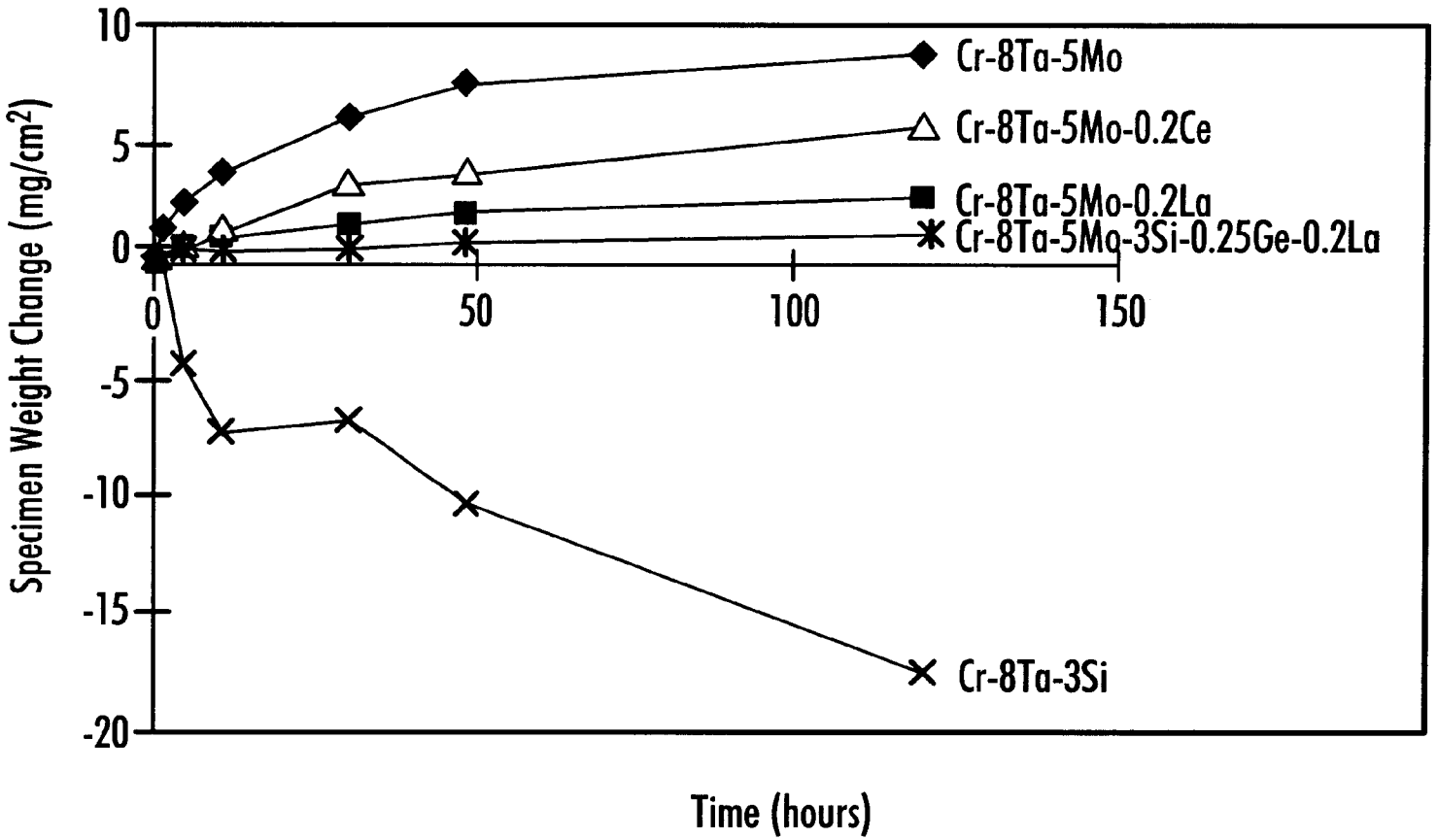
FIG. 6 is a graph of weight vs time for the cyclic oxidation at 1100° C. showing the beneficial effect of Si, Ge, Ce and La additions to Cr—8Ta alloy.

Oxidation properties of the alloys were studied by exposing coupon specimens to air at temperatures to 1100° C. Results are shown in FIG. 4 for as-cast Cr—8Ta, Cr—10Ta, Cr—10Nb and pure Cr (all compositions reported in atomic percent). The Cr—10Nb and the unalloyed Cr samples showed severe spalling during the cycling as can be seen from the rapid loss in weight after 30 hours of exposure. The Cr—Ta alloys showed superior oxidation resistance, with no spalling evident in the Cr—10Ta sample and only slight spalling in the Cr—8Ta sample. Additions of 1, 2.5, and 5 Mo (atomic percent) for Cr were effective in eliminating the spalling in Cr—8Ta (FIG. 5). Additions of reactive elements such as La, Ce, Y and other rare earth elements further improve oxidation resistance (FIG. 6 shows data for La and Ce additions). Additions of Si lower the isothermal rate of oxidation but result in a greatly increased tendency to spall under thermal cycling conditions (FIG. 6). However, the addtion of a reactive element such as La in combination with Ge can ameliorate the tendency of Si bearing alloys to scale spallation under thermal cycling conditions, resulting in still further improvement in oxidation resistance (FIG. 6).

We prepared the alloy compositions shown in Table 1 by melting and casting. The cast binary Cr—Ta, when viewed under an optical microscope at 625× shows a mixture of two phases: a Cr-rich solid solution (bright contrast) and an eutectic structure of Cr—$Cr_2Ta$ (dark contrast) of FIG. 1.

TABLE 1

Alloy composition of Cr-Ta base alloys

| Alloy No. | Composition (at %) |
|---|---|
| CRT-100 | 3.0 Ta |
| CRT-101 | 6.0 Ta |
| CRT-102 | 8.0 Ta |
| CRT-103 | 9.0 Ta |
| CRT-104 | 9.5 Ta |
| CRT-105 | 9.8 Ta |
| CRT-106 | 10.0 Ta |
| CRT-107 | 13.0 Ta |
| CRT-108 | 8.0 Ta-1 Mo |
| CRT-109 | 8.0 Ta-3 Mo |
| CRT-110 | 8.0 Ta-5 Mo |
| CRT-111 | 10.0 Ta-0.1 Ti |
| CRT-112 | 10.0 Ta-0.5 Ti |
| CRT-113 | 8.0 Ta-1 Si |
| CRT-114 | 8.0 Ta-3 Si |
| CRT-115 | 8.0 Ta-0.01 Y |
| CRT-116 | 8.0 Ta-0.1 Y |
| CRT-134 | 8.0 Ta-2.5 Mo-0.5 Ti |
| CRT-135 | 8.0 Ta-2.5 Mo-0.1 Ti-3 Si-0.01 Y |
| CRT-133 | 8.0 Ta-2.5 Mo-0.5 Ti-3.0 Si |
| CRT-130 | 8 Ta-5.0 Mo-0.5 Ti |
| CRT-131 | 8 Ta-5.0 Mo-0.5 Ti-3.0 Si |
| CRT-132 | 8 Ta-5.0 Mo-0.5 Ti-3.0 Si-0.05 Mg |
| CRT-136 | 8 Ta-6.5 Mo-0.5 Ti-0.05 Mg |
| CRT-137 | 8 Ta-6.5 Mo-0.5 Ti-0.05 Mg-0.023 Ce |
| CRT-154 | 8 Ta-5.0 Mo-0.5 Ti-0.1 La |
| CRT-155 | 9.75 Ta-5 Mo-0.5 Ti-0.1 La |
| CRT-156 | 8 Ta-5.0 Mo-3.0 Si-0.5 Ti-0.1 La |
| CRT-157 | 8 Ta-5.0 Mo-3.0 Si-0.25 Ge-0.5 Ti-0.1 La |

TABLE 2

Electron microprobe analyses of phase compositions in Cr-Ta alloys CRT-136 and 137

| Alloy No. | $Cr_2Ta$-type phase | Cr-rich phase |
|---|---|---|
| CRT-136 | Cr = 67.99 | 93.19 |
| | Ta = 27.00 | 0.74 |
| | Mo = 4.98 | 6.04 |
| | Ti = 0.03 | 0.03 |
| CRT-137 | Cr = 67.94 | 92.24 |
| | Ta = 26.06 | 0.80 |
| | Mo = 5.87 | 6.95 |
| | Ti = 0.12 | 0.00 |
| | Ce = 0.01 | 0.01 |

TABLE 3

Tensile properties of CRT alloys based on Cr-8% Ta

| Test | | Strength (Ksi) | | |
|---|---|---|---|---|
| Temperature | Alloy No. | Yield | Ultimate | Elongation (%) |
| Room Temperature | CRT-133 | | 101 | 0.5 |
| | CRT-130 | | 104 | 0.5 |
| | CRT-131 | | 70.8 | 0.4 |
| | CRT-132 | | 71.2 | 0.4 |
| | CRT-136 | | 88.6 | 0.5 |
| | CRT-137 | | 92.0 | 0.5 |
| | CN-52* | | 34.5 | 0.2 |
| 800° C. | CRT-133 | | 69.3 | 0.4 |
| | CRT-130 | 120 | 120 | 0.5 |
| | CRT-131 | | | |
| | CRT-132 | 134 | 138 | 1.0 |
| | CRT-136 | | 117 | 0.5 |
| | CRT-137 | 128 | 131 | 0.9 |
| 1000° C. | CRT-133 | 80.5 | 88.5 | 8.6 |
| | CRT-130 | 85.6 | 96.5 | 7.6 |

TABLE 3-continued

Tensile properties of CRT alloys based on Cr-8% Ta

| Test | | Strength (Ksi) | | |
|---|---|---|---|---|
| Temperature | Alloy No. | Yield | Ultimate | Elongation (%) |
| | CRT-131 | | | |
| | CRT-132 | 96.5 | 104 | 3.1 |
| | CRT-136 | 91.4 | 106 | 2.5 |
| | CRT-137 | 88.2 | 99.4 | 5.7 |
| | CN-52* | | 49.6 | 0.3 |
| 1200° C. | CRT-133 | 30.0 | 35.8 | 22.0 |
| | CRT-130 | 37.1 | 45.0 | 16.6 |
| | CRT-131 | 41.6 | 51.2 | 18.5 |
| | CRT-132 | 46.8 | 56.5 | 9.7 |
| | CRT-136 | 46.1 | 56.4 | 14.3 |
| | CRT-137 | 36.7 | 45.2 | 28.1 |

*A Cr-Nb base alloy (Cr-5.6Nb-4Re-1.5Al, at. %) developed previously.

Figure 2:
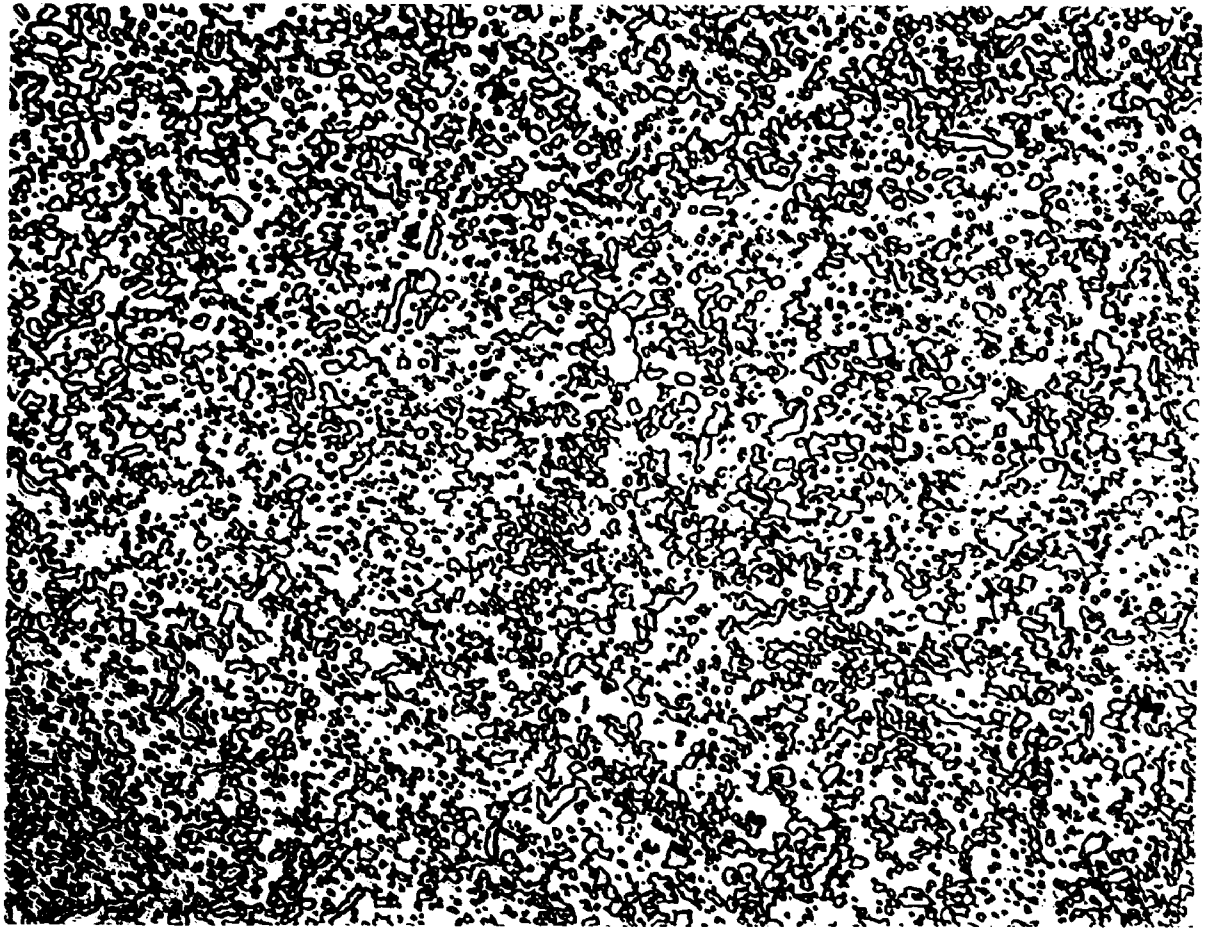
FIG. 2 is an optical photomicrograph of extruded and annealed CRT-136.
Figure 3:
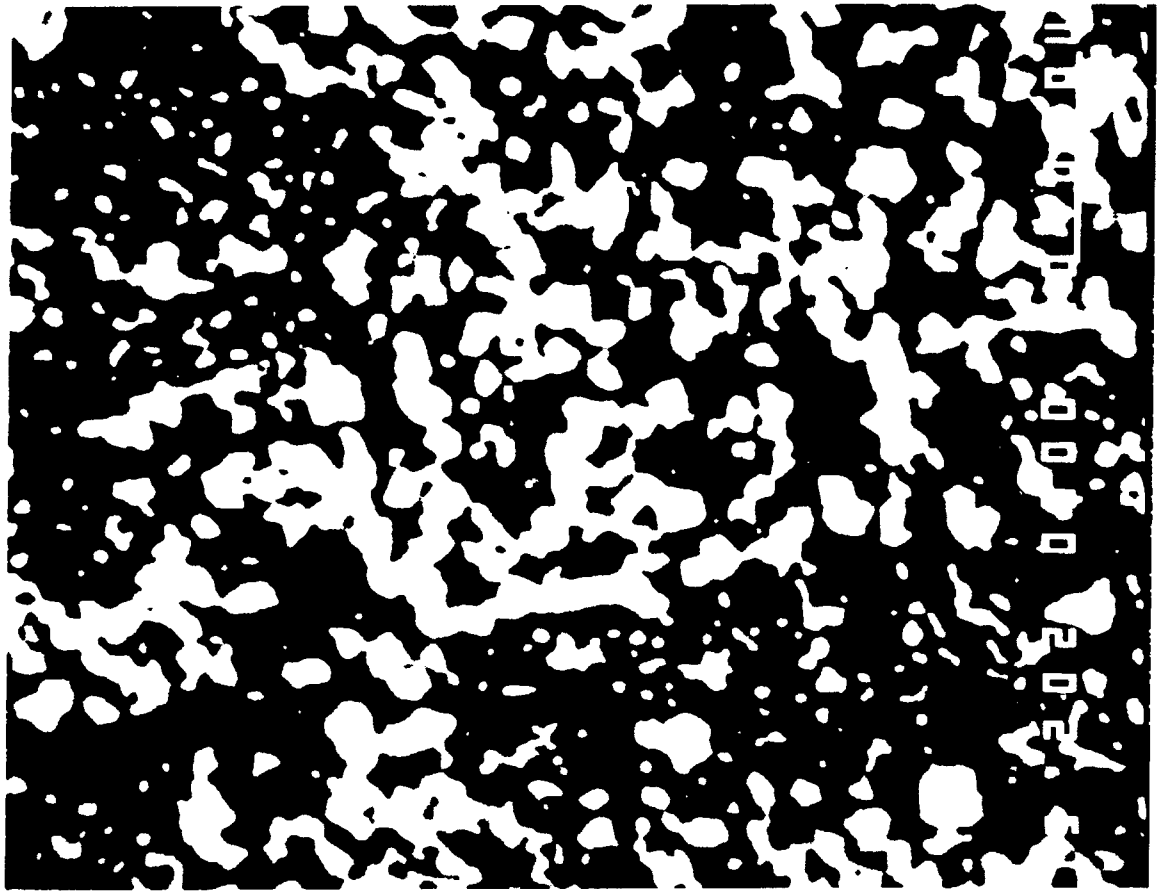
FIG. 3 is a back-scattered electron (BSE) image of CRT-136.

The ternary and higher samples, identified as series CRT-130 to 137, were selected for hot extrusion in Mo cans at an extrusion ratio of 9 to 1 at 1480° C. Extrusions were then annealed for one day at 1200° C. The optical micrograph of a representative example, CRT-136 is shown in FIG. 2. It is noted that the hot extrusion refines the coarse non-uniform structure of the as-cast material into a fine precipitation of blocky-type Laves-phase particles within a Cr-rich matrix. This sample was further analyzed by wave-length dispersive spectroscopy (WDS) using an electron microprobe. FIG. 3 is a back-scatter electron (BSE) image showing the mainly fine precipitates in a dark matrix.

WDS data was used to identify the alloy composition of the samples CRT-136 & CRT-137. Table 2 summarizes the results. The particles have the composition close to a Laves-phase of $Cr_2(Ta,Mo)$, and the matrix is a Cr-rich solid solution containing 6 to 7 percent Mo. It is interesting to point out that Mo is roughly equally distributed in the Laves-phase particles and the matrix, with a slight enrichment in the Cr-rich matrix. In the Laves-phase particles, Mo atoms are believed to essentially occupy the Ta sub-lattice sites resulting in an increase in the volume fraction of the Laves-phase by alloying with Mo additions in the Cr—Ta alloys. Ti additions scavage oxygen in the alloys, resulting in the formation of Ti-rich oxides as detected by electron microprobe analysis.

The mechanical properties of the alloys were determined by tensile testing of button-type rod specimens having a gage diameter of 0.125 inches (20 mm). Tests were performed at room temperature, 800° C., 1000° C., and 1200° C. The tests were carried out in air, except that 1200 degree C. tests were performed in a vacuum to avoid oxidation of the TZM pullrods. Table 3 summarizes the tensile results in terms of strength and elongation percent and compares the results to the Cr—5.6Nb—4Re—1.5Al alloy, an example of that which was covered by U.S. Pat. No. 5,282,907. The alloys of this invention show a higher fracture strength than the reference sample at room temperature and 1000° C. It is interesting to note that the Cr—8Ta alloys show significant plastic deformation at 1000° C. and above but maintain good yield and ultimate tensile strengths even at 1200° C. It is noted, for comparison, that the strengths of polycrystal Ni-based superalloys generally drop asymptotically toward zero at 1200° C.

The properties of the Cr—Ta alloys can be further improved in tensile strength by the introduction of Mo and Ti. Mo is more effective in improving tensile strength at and above 1000° C. A total amount of Mo plus Si of about 4 to 6 percent improves fracture strength at room temperature and fracture ductility at elevated temperatures. Unfortunately, at temperatures over 1000° C., the Si reduces the oxidation resistance and causes spalling. The additions of Si with Ge and La are beneficial, as shown in FIG. 6. Cerium has been found to improve ductility, but to lower tensile strength at very high temperatures.

The invention will be further described in terms of the following examples which illustrate but do not limit the scope of this invention.

EXAMPLE 1

Figure 1:
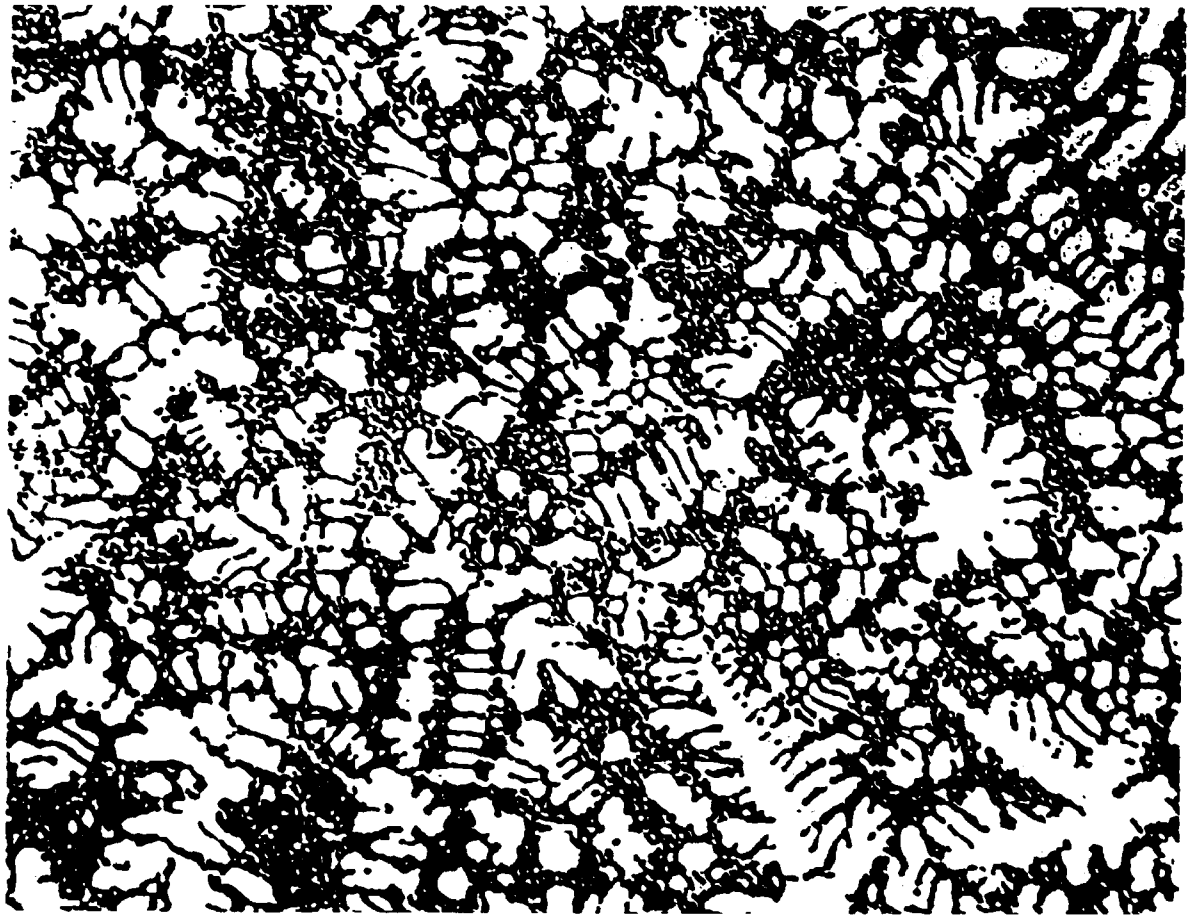
FIG. 1 is a photomicrograph showing the microstructure of Cr-8% Ta alloy as cast.

In this study, Cr—Ta binary alloys were prepared by arc melting and drop casting. Cr and Ta metal chips were first weighed and mixted at a pre-set alloy composition. The pure metal chips were then placed in a water-cooled Cu hearth, melted by arc heating, and drop cast into Cu molds. The resultant ingots had diameters from 0.25 to 1.0 in. By this method, alloys identified in Table 1 as CRT-100 through 107 were prepared. The as-cast material at magnification in an optical microscope of 625× is seen in FIG. 1 for representative Cr-8 at % Ta (CRT-102). The objective of this work is to determine the hypoeutectic, eutectic and hypereutectic compositions by control of Ta concentration. The results of this study indicate that the eutectic composition of the Cr—$Cr_2Ta$ system is around Cr-9.8% Ta, instead of Cr-13 % Ta reported by other investigators (see FIG. 7).

EXAMPLE 2

To study the oxidation behavior of the alloys, disc shaped samples approximately 1 to 1.5 cm in diameter and 1 mm in thickness were cut from arc-cast cylinders made from high-purity chips of the constituent elements and polished to a 600 grit finish by wet abrading using SiC grinding paper. The samples were placed in an alumina crucible and covered with an alumina lid. At intervals of 1, 4, 10, 30, 48, and 120 hours the samples were removed from the furnace, air cooled, weighed, and returned to the furnace. The weight changes were measured as a function of exposure time, as shown in FIGS. 4 to 6. The results so obtained were compared with pure Cr and Cr—$Cr_2Nb$ alloys.

EXAMPLE 3

Cr—Ta alloys containing other alloying additions were prepared by mixing pure Cr, Ta, Mo, Si, Ti, Ge, and rare-earth metal chips to obtain the atomic percentages listed in Tabe 1, samples 108–137 and 154 to 157. These mixtures were then arc melted and drop cast into Cu molds. A part of the alloy ingots 108–137 were further sectioned for hot fabrication. The sectioned ingots were then canned in Mo billets and hot extruded at temperatures above 1450° C. The extruded alloy pieces were finally removed from extruded cans for property measurements. Their microstructures are shown in FIGS. 2 and 3, and their mechanical properties are summarized in Table 3 as a function of test temperatures to 1200° C. The microstructural examination indicates that hot extrusion mainly refines eutectic structures and produces block type $Cr_2Ta$ particles in the Cr matrix.

We claim:

1. Chromium based alloy consisting essentially of 8.0 atomic % Ta, 5.0 atomic % Mo, 3.0 atomic % Si, 0.25 atomic % Ge, 0.2 atomic % La, balance Cr.

* * * * *